US005683078A

United States Patent [19]

Schieck

[11] Patent Number: 5,683,078

[45] Date of Patent: Nov. 4, 1997

[54] ADJUSTABLE SKEW OFFSET DEVICE

[75] Inventor: Richard A. Schieck, Rochester, N.Y.

[73] Assignee: Xerox Corporation, Stamford, Conn.

[21] Appl. No.: 533,037

[22] Filed: Sep. 25, 1995

[51] Int. Cl.[6] ..... B65H 9/16

[52] U.S. Cl. ..... 271/250; 271/252; 271/253

[58] Field of Search ..... 271/249, 250, 271/251, 252, 253, 226, 227

[56] References Cited

U.S. PATENT DOCUMENTS

| | | | |
|---|---|---|---|
| 3,929,327 | 12/1975 | Olson | 271/250 |
| 4,955,965 | 9/1990 | Mandel | 271/225 |
| 5,049,929 | 9/1991 | Anderson et al. . | |

OTHER PUBLICATIONS

IBM Technical Disclosure Bulletin vol. 22 No. 5 Oct. 1979 pp. 1746–1748 "Paper Feed" by S. P. Garrison and R.A. Rachui.

XDJ vol. 20, No. 1, pp. 13–16.

*Primary Examiner*—David H. Bollinger

*Attorney, Agent, or Firm*—William A. Henry, II

[57] ABSTRACT

An adjustable skew offset device includes a tapered roll as a paper drive roll and a line contact idler roll which is axially adjustable. With these two rolls forming a nip, paper passing therethrough can be purposely skewed clockwise or counterclockwise and thereby serving either to compensate for any fixed skew offset in the paper path or to null out any skew offset between small and large size papers.

11 Claims, 4 Drawing Sheets

ADJUSTABLE SKEW OFFSET DEVICE

BACKGROUND OF THE INVENTION

This invention relates to an adjustable skew offset device for use in the paper path of a machine, and especially useful when a slitter/perforator apparatus is employed with the machine.

In copiers and printers, paper transport hardware within the machine may be less than perfectly aligned, causing a shift in skew of all papers within the machine relative to some machine datum. Additionally, papers of different lengths (perpendicular to the process direction) may tend to skew different amounts as they pass through the paper path, owing to drag forces of the sheet. This is especially true of machines where the range of paper size is large and the sheets are side registered, such that paper drive components are not centered on the sheet. Also, the extra 6 inches of length of a 17 inch sheet expose it to drag forces above and beyond the drag of an 11 inch sheet, causing the sheet to rotate as it passes through the copier. This shows up as skew offset between 17 inch and 11 inch papers. Any downstream equipment requiring removal of this skew offset, such as, a slitter/perforator will benefit from the addition of a device that will accomplish skew correction in a paper path in a timely and efficient way.

PRIOR ART

A device that is used for adjusting the skew of one side of a drive roll for advancing a sheet in a copier or printer is shown in the Xerox Disclosure Journal, Vol. 20, No. 1, pp. 13–16. The periphery of one of a pair of drive rolls is made to be larger than the other in order to accomplish skew correction.

U.S. Pat. No. 4,955,965 discloses a device capable of rotating sheets 90° C. relative to an input orientation and utilizes a set of continuously driven rolls all turning with different surface velocities.

SUMMARY OF THE INVENTION

Accordingly, an adjustable skew offset device is disclosed that includes a tapered roll as a paper drive roll and a line contact idler roll which is axially adjustable. With these two rolls forming a nip, paper passing therethrough can be purposely skewed clockwise or counterclockwise and thereby serving either to compensate for any fixed skew offset in the paper path or to null out any skew offset between small and large size papers.

DESCRIPTION OF THE DRAWINGS

All of the above-mentioned features and other advantages will be apparent from the example of one specific apparatus and its operation described hereinbelow. The invention will be better understood by reference to the following description of this one specific embodiment thereof, which includes the following drawing figures (approximately to scale) wherein.

DETAILED DESCRIPTION OF THE PREFERRED EMBODIMENT

Figure 1:
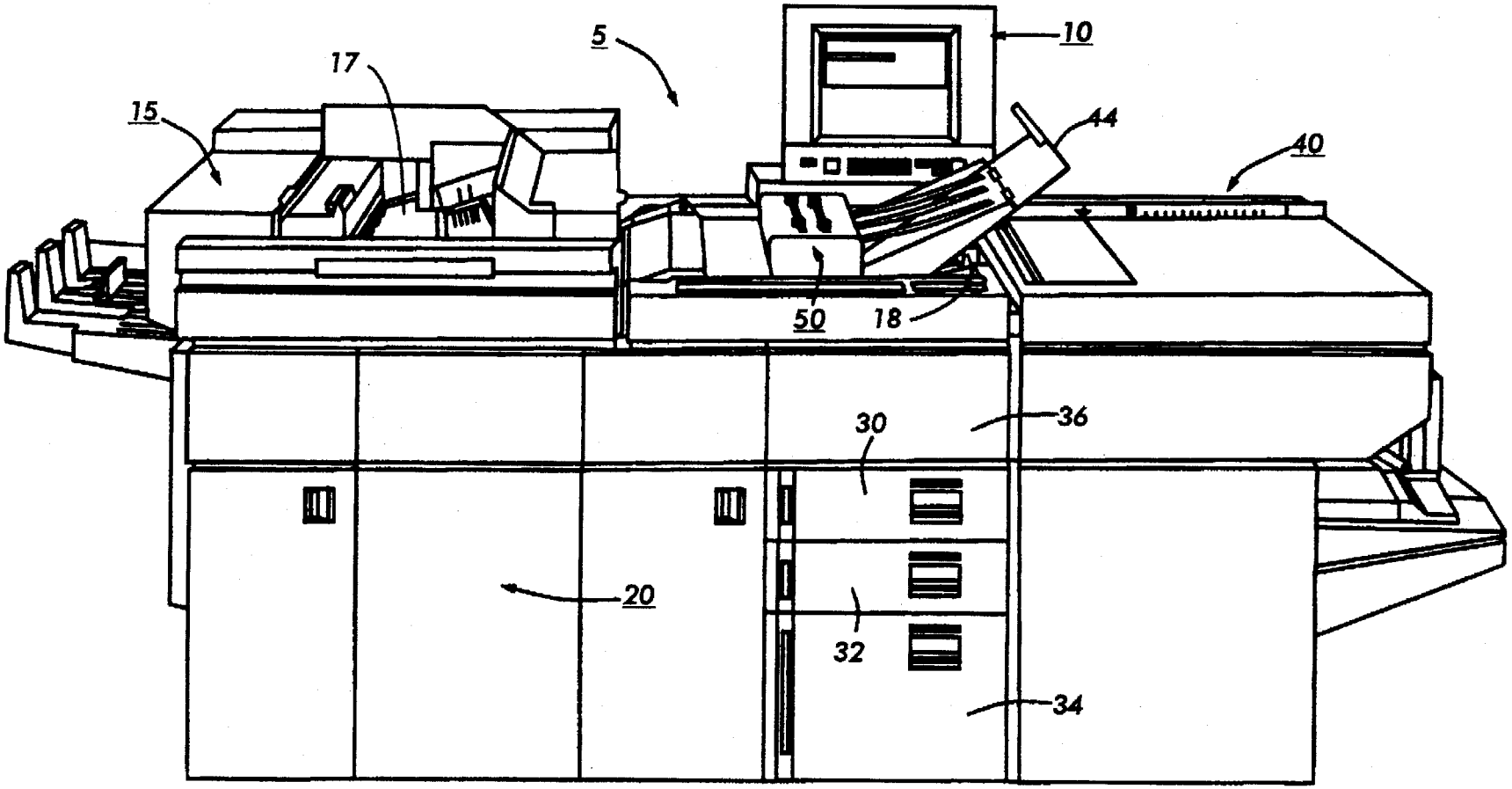
FIG. 1 is an isometric view of an illustrative reproduction machine incorporating the adjustable skew offset device of the present invention.

For a general understanding of the features of the present invention, reference is made to the drawings. In the drawings, like reference numerals have been used throughout to identify identical elements. Referring to FIG. 1, there is shown an electrophotographic printing machine 5 composed of a plurality of programmable components and subsystems which cooperate to carry out the copying or printing programs through the touch dialogue User Interface (UI) 10. However, it should be understood that the apparatus of the present invention can be used with any device that feeds sheets, such as, a printer or in any environment where slitting or perforating is required.

Conventionally, machine 5 shown in U.S. Pat. No. 5,049,929 which is incorporated herein by reference, employs a recirculating document handler 15 having a document support surface 17 onto which documents are placed. The documents are fed individually to an imaging station where they are imaged within housing 20 onto a photoconductive belt corresponding to the informational areas contained within a document currently at the imaging station. After imaging, each document is returned to the document handler support surface 17 via a simplex path when either a simplex copy or the first pass of a duplex copy is being made or via a duplex path when a duplex copy is being made. Each image is developed on the photoreceptor, transferred and fused to copy sheets fed from either of paper trays 30, 32 or 34 through housing 36 to output tray 44 or finisher 40. If the slitting and/or perforating is not required, copy sheets pass through slitter/perforator 50 with unactuated. The slitter/perforator is actuated by touching an icon on UI 10 n an appropriate location if there is a desire to slit or perforate copy sheets.

Top adjustable slitter/perforator 50 as shown in commonly assigned U.S. application Ser. No. 08/314,110 filed Sep. 28, 1994 and incorporated herein by reference adds easily adjustable on-line slitting and perforating capability to machine 5 as copy sheets are fed to top output tray 44. Most slitters and perforators are not easy to adjust. They require an allen wrench and must be adjusted by a service technician and are positioning limited by paper guides. In contrast, top adjustable slitter/perforator 50 is operator adjustable from the top of the apparatus simply by turning a lock adjustment knob counterclockwise, sliding slitter or perforator housings along a slot in a support shaft, lining the slitter and/or perforator up with a dimensioned label for the desired location, and turning the lock adjustment knob clockwise to lock the housing into the location. No tools are required and the unit is also adjustable while paper is moving through it, i.e., the machine does not have to stop paper movement through the machine in order for different positioning of the slitter and/or perforator housings to take place.

Figure 2:
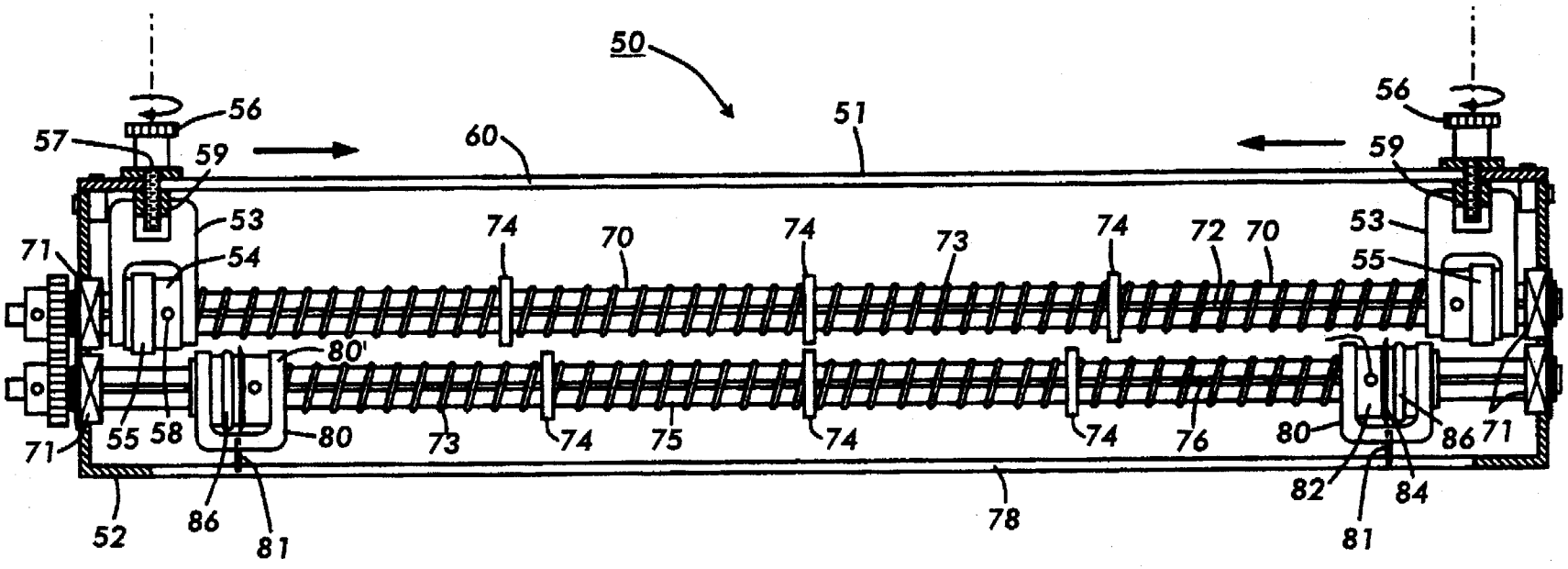
FIG. 2 is an end view of the slitter/perforator used with the machine of FIG. 1 in a non-perforating position.

In FIG. 2, an end view of the perforator portion of slitter/perforator 50 is shown encased in cover 51 and U-shaped frame member 52 and located in a non-perforating position and includes movable housings 53 which are connected to cover 51 by way of lock adjustment knobs 56. The knobs have threaded portions 57 threadably connected to movable oval shaped pin 59. The pins are oval shaped so that there is no rotation when the knobs are tightened. As knobs 56 are rotated clockwise, oval shaped pins 59 are compressed against cover 51, locking housings 53 to cover 51.

Each of the oval shaped pins 59 can move up an down but not transversely as tightening takes place. When movement of housings 53 along slot 60 is desired, each lock adjustment knob 56 is turned counterclockwise and adjustment or positioning to a predetermined location is accomplished. Two shafts 70 and 75 are rotatably mounted in bushings or bearings 71 supported in U-shaped frame portion 52. Shaft 70 has slidable or transversely movable housings 53 mounted thereover through a cylindrical hole in cylinder 54. Cylinders 54 and 55 have a pin 58 interiorly protruding therefrom that rides in slot 72 in shaft 70. Shaft 75 has perforator housings 80 movably mounted thereon through cylinder 82 and pin 83 which rides in slot 76 of shaft 75. Pins 81 stabilize housing 80 within slot 78 in frame 52 A perforating blade 84 is mounted on cylinder 82 and an O-ring 86 is positioned on cylinder 82 for ensuring that copy sheets passing thereon are level and applies frictional drive to copy sheets traveling toward output tray 44. The O-ring ensures straight slits and perforations. Housing 80 has a sheet guide surface 80' that directs the copy sheet through the housing and prevents the copy sheet from wrapping around cylinder 82 and away from the direction of travel due to the tendency of the perforating wheel to drive sheets away from the feed path during the perforating process. Compression springs 73 are used to bias the housings outward toward the inside surfaces of U-shaped frame portion 52 and present a nearly constant sliding force to an operator when adjustment of the perforator housings is required. A slot 60 allows housings 53 to be moved toward each other in the direction of the arrows and back to their original positions. Paper guide washers 74 stay centered when adjustments are made to the perforator housings due to contact with low rate springs 73 which also apply side load on the perforator housings.

Figure 3:
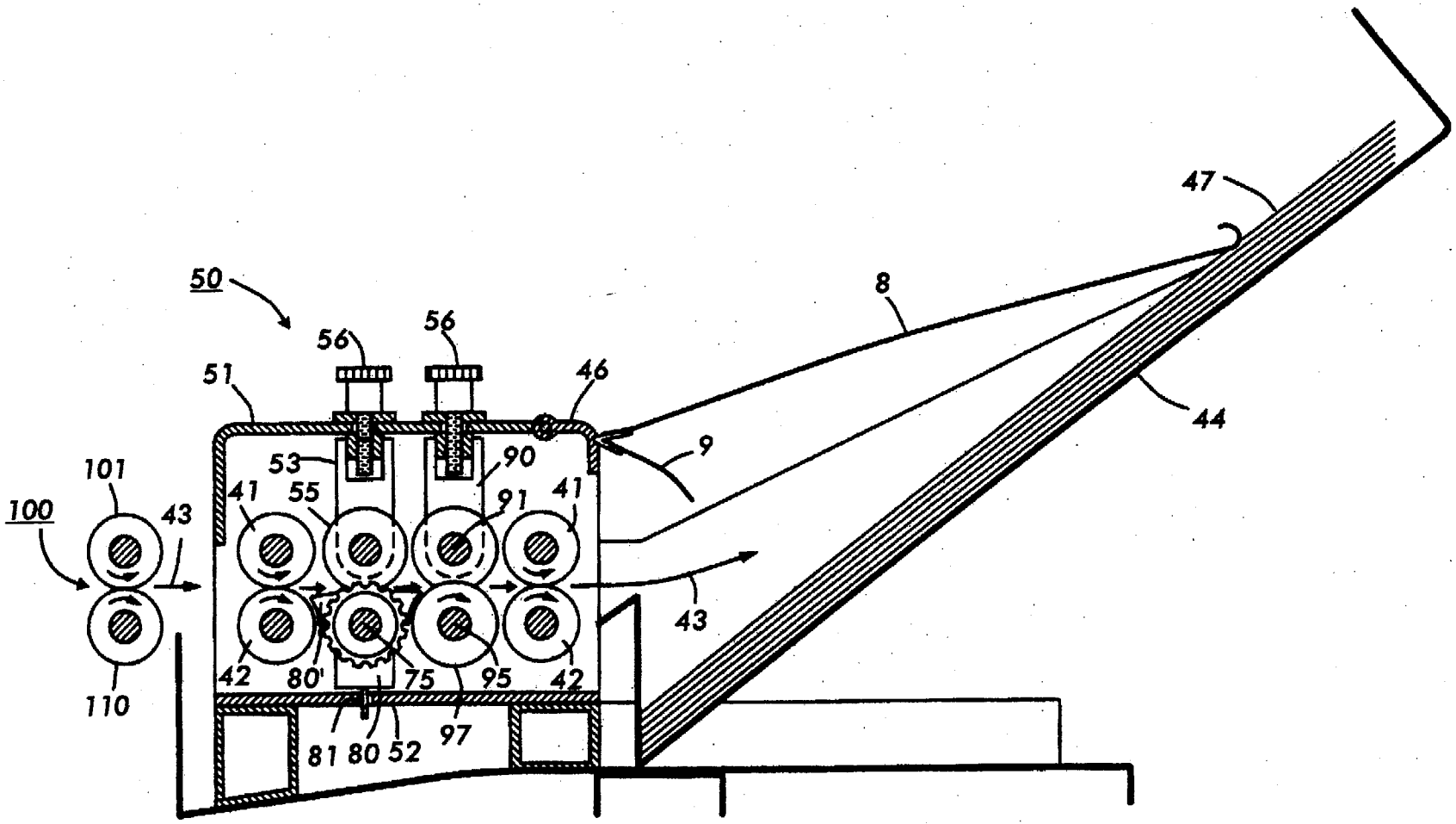
FIG. 3 is an side view of the slitter/perforator of FIG. 2 in a perforating position and showing the adjustable skew offset device of the present invention in position to drive sheets into the slitter/perforator.

Sheets entering slitter/perforator 50 in FIG. 3 are driven and deskewed by adjustable skew offset device 100 of machine 5 into housing 51 and into a nip formed between drive rollers 41 and 42 in the direction of arrows 43 that represent the path of sheets transported through the slitter/perforator. If the slitter/perforator 50 is actuated, perforator wheel 84 places perforations in the sheet as it passes thereover and slitter 97 supported by shaft 95 slits the sheets before they are driven out into output tray 44 by another set of drive rollers 41 and 42. The sheets can continue to stack up as they enter output tray 44 until the height of the stacked sheets causes a full condition and causes a corrugation in the paper path which lifts door 46 which has a conventional limit switch (not shown) attached thereto. Lifting of the door by the stacked sheets actuates the limit switch which stops the machine. Paper guides 8 ensure that the lead edges of sheets 47 are properly positioned in tray 44 and trail edges of the copy sheets are guided down and out of the path of incoming copy sheets by trail edge guides 9.

Figure 4:
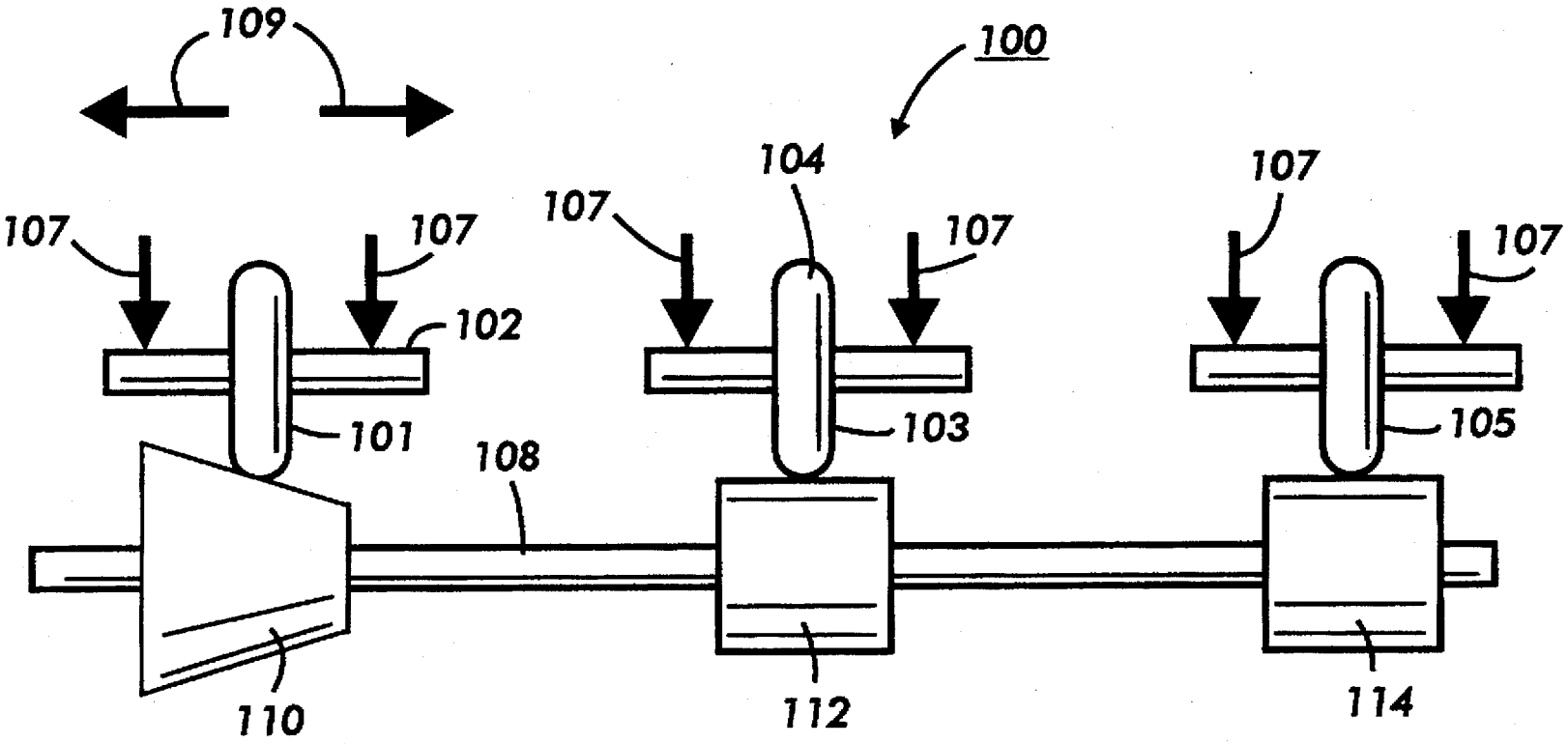
FIG. 4 is an enlarged end view of one of the adjustable skew offset device of FIG. 3.

Registration of copy sheets for straight perforations and slits with respect to the image on the copy sheets is enabled through the present invention by rotating knob 18 clockwise or counterclockwise. Knob 18 is connected for rotatable movement of adjustable skew offset device 100 through conventional means, such as, a rack and pinion mechanism (not shown). As shown in FIG. 4, adjustable skew offset device 100 includes a set of transport rolls with the lower drive rolls 110, 112 and 114 being fixed to rotatable shaft 108 and adapted to turn as a unit. The drive rolls may be rubber coated, if desired. The upper idler rolls 101,103 and 105 are mounted on rotatable shafts 102, 104 and 106, respectively, to form nips with drive rolls 110, 112 and 114. All of the idler rolls represented in FIG. 4 by arrows 107 are individually spring loaded against the drive rolls by conventional means. Drive roll 110 is purposely tapered from one end to the other. Riding on this tapered roller is either a narrow roll 101 or a line contact idler, such as, an O-ring stretched over a hub. The position of roller 101 is adjustable axially as indicated by arrow 109 by rotation of knob 18 to accomplish deskewing of sheets passing through the skew offset device. If the idler roll 101 is adjusted to the right, the effective drive speed on that side of a sheet is decreased, causing the sheet to skew in one direction. When the idler position is adjusted to the left, the effective drive speed is increased, causing the sheet to skew in the opposite direction.

If adjustable idler/tapered roll assembly is positioned such that it contacts only the largest (inboard edge of the FIG. 1 machine's paper path), then these sheets can be steered into equalization with smaller sheets. If the adjustable idler/tapered roll assembly is positioned such that it contacts all sheets (outboard edge of the FIG. 1 machine's paper path), then all sheets can be steered to some desired skew offset to align with output device 44, finisher 40 or some other reference datum.

While the schematic in FIG. 4 is exaggerated for description purposes, experimenting with a typical situation shows that only a modicum of taper of drive roll 110 is required to accomplish required deskewing of sheets. For example, a drive roll of 25 mm nominal diameter and 25 mm long was tested. For skew adjustment of 11×17 inch sheets of ±10 mR (±4 mm at lead edge), the taper from one end of the roll to the other was about 0.5 mm on the radius.

It should now be apparent that a top adjustable skew offset device for aligning sheets with a reference datum of a machine has been disclosed that features an operator adjustable idler roll that is in contact with the outer surface of a tapered drive roll. Adjustment of the idler roll positioning with respect to the outer surface of the tapered drive roll will cause sheets passing through the nip formed between the two members to be purposely skewed clockwise or counterclockwise thereby serving to either compensate for any fixed skew offset in the sheet path or to null out any skew offset between small and large size papers.

While the embodiment shown herein is preferred, it will be appreciated that it is merely one example, and that various alterations, modifications, variations or improvements thereon may be made by those skilled in the art from this teaching, which is intended to be encompassed by the following claims:

What is claimed is:

1. In a reproduction machine which feeds imaged copy sheets to an output tray, the improvement of a skew offset correction device for removing skew in sheets en route to the output tray, comprising:

a tapered drive roll;

an axially adjustable idler roll that makes line contact with said tapered drive roll to form a nip therewith; and means for adjusting said idler roll axially along an outer surface of said tapered drive roll in either of two directions such that adjustment of said idler roll in a first direction with respect to the surface of said tapered drive roll causes a sheet driven through said nip to skew in a first direction and adjustment of said idler roll in a second direction with respect to the surface of said tapered drive roll causes a sheet driven through said nip to skew in a second and opposite direction.

2. The improvement of claim 1, wherein said idler roll comprises an O-ring stretched over a hub.

3. The improvement of claim 1, wherein said idler roll is spring loaded against said tapered drive roll.

4. The improvement of claim 3, wherein said tapered drive roll is fixedly attached to a rotatable shaft, said rotatable shaft additionally including at least two non-tapered drive rolls.

5. The improvement of claim 4, including idler rolls spring loaded against said at least two non-tapered drive rolls.

6. A skew offset correction device for removing skew in sheets as they are transported along, a sheet transport, comprising:

a tapered drive roll;

an axially adjustable idler roll that makes line contact with an outer surface of said tapered drive roll to form a nip therewith; and means for adjusting said idler roll axially along said outer surface of said tapered drive roll in either of two directions such that adjustment of said idler roll in one direction along the surface of said tapered drive roll decreases the drive speed of said nip causing the sheet to skew in said one direction and adjustment of said idler roll in an opposite direction increases the drive speed of said nip causing the sheet to skew in the other of said two directions.

7. The improvement of claim 2, wherein said idler roll comprises an O-ring stretched over a hub.

8. The improvement of claim 2, wherein said idler roll is spring loaded against said tapered drive roll.

9. The improvement of claim 8, wherein said tapered drive roll is fixedly attached to a rotatable shaft, said rotatable shaft additionally including at least two non-tapered drive rolls.

10. The improvement of claim 9, including idler rolls spring loaded against said at least two non-tapered drive rolls.

11. The improvement of claim 2, including a slitter/perforator having a sheet entrance and exit portion, and wherein said nip formed between said tapered drive roll and said idler roll is positioned immediately preceding said entrance portion of said slitter/perforator.

* * * * *